United States Patent [19]

Shimada et al.

[11] Patent Number: 4,915,901

[45] Date of Patent: Apr. 10, 1990

[54] REINFORCING STEEL HAVING RESISTANCE TO SALT AND CAPABLE OF PREVENTING DETERIORATION OF CONCRETE

[75] Inventors: Haruo Shimada; Yoshiaki Sakakibara, both of Kawasaki; Takashi Waseda, Tokyo, all of Japan

[73] Assignee: Nippon Steel Corporation, Tokyo, Japan

[21] Appl. No.: 803,284

[22] Filed: Dec. 2, 1985

[30] Foreign Application Priority Data

| | | | |
|---|---|---|---|
| Dec. 18, 1984 | [JP] | Japan | 59-265277 |
| Jun. 3, 1985 | [JP] | Japan | 60-120316 |
| Jun. 10, 1985 | [JP] | Japan | 60-124198 |

[51] Int. Cl.[4] ..... C22C 38/44

[52] U.S. Cl. ..... 420/119; 420/122

[58] Field of Search ..... 75/124; 420/119, 122, 420/89, 92, 93; 148/336

[56] References Cited

FOREIGN PATENT DOCUMENTS

| | | | |
|---|---|---|---|
| 56-09356 | 1/1981 | Japan | 420/122 |
| 59-44457 | 3/1984 | Japan . | |
| 1116651 | 6/1968 | United Kingdom . | |

*Primary Examiner*—Deborah Vee

*Attorney, Agent, or Firm*—Pollock, Vande Sande & Priddy

[57] ABSTRACT

A high-purity reinforcing steel resistant to salt and capable of preventing deterioration of concrete substantially completely over a long period when the salt content of the concrete is not greater than 0.5 wt % in terms of Nacl amount in the sand of concrete. The reinforcing steel essentially consists of 0.001 to 1.0 wt % of C, less than 0.01 wt % of Si, 0.01 to 2.0 wt % of Mn, less than 0.015 wt % of P, less than 0.005 wt % of S, 0.01 to 0.5 wt % of Cu, 0.01 to 0.5 wt % of W, 0.001 to 0.10 wt % of Al and the balance Fe and incidental impurities. Disclosed also is another reinforcing steel capable of remarkably retarding deterioration of concrete even under such a severe corrosive condition that the salt content of the concrete exceeds 0.5 wt % in terms of Nacl amount in the same of concrete. This reinforcing steel essentially consists of 0.001 to 1.0 wt % of C, not greater than 0.05 wt % of Si, 0.01 to 2.0 wt % of Mn, less than 0.015 wt % of P, less than 0.005 wt % of S, 1.0 to 5.5 wt % of Ni, 0.001 to 0.5 wt % of W, 0.001 to 0.1 wt % of Al and the balance Fe and incidental impurities.

11 Claims, 5 Drawing Sheets

REINFORCING STEEL HAVING RESISTANCE TO SALT AND CAPABLE OF PREVENTING DETERIORATION OF CONCRETE

BACKGROUND OF THE INVENTION

The present invention relates to a reinforcing steel having distinguished resistance to salt and preventive of deterioration of concrete, suitable for use in concrete structures or concrete bridges which are built on beach, seashore or offshore where they are exposed to salt particles or splashes of sea water.

Recently, various methods have been proposed and carried out which are preventive of cracking in various steel-reinforced concrete building construction making use of sea sand, as well as concrete structures which are situated on beaches or seashores.

The deterioration of concrete in the constructions and structures of the type mentioned above is attributable mainly to corrosion of the reinforcing steel by salt inherently contained by the sea sand or salt which has penetrated the concrete wall which is subjected to the salty atmosphere in the shore area. Namely, the corroded steel expands to increase its volume to about 2.2 times the original volume through the creation of corrosion products, so that the concrete can not withstand the expansion to thereby cause cracks along the reinforcing steel. When the crack grows to 0.2 mm or greater in size, oxygen, salt and carbon dioxide gas in the air penetrates into the concrete through the crack to reach the reinforcing steel. The salt promotes both the corrosion of the reinforcing steel and neutralization of concrete, thus accelerating the deterioration of the concrete.

The present inventors have made an intense study for developing reinforcing steel having improved salt resistance, through a suitable control of the chemical composition of the reinforcing steel and addition of special elements to the steel composition, and succeeding in developing a reinforcing steel as shown in Japanese Unexamined Patent Publication Nos. 48054/1982 and 44457/1984. This steel is disclosed also in other literatures such as "OFFSHORE GOTEBORG '81" Paper No. 42, Goteborg SWEDEN 1981, "CEMENT CONCRETE" No. 434 (1983) P. 23/31, and "Corrosion of Reinforcement in Concrete Construction" P. 419, 1983. These literatures detail the anti-salt mechanisms of the elements of the steel which contributes to the improvement in the anti-salt properties, and some of the steel compositions proposed in these literatures have been already put into practical use.

It is a current demand to substantially prevent the corrosion of the reinforcing steel and the resultant cracking in the concrete, both of which are attributable to penetration of salt particles and the splash of salt through concrete walls.

Problems are becoming serious in various fields in regard to cracking in concrete constructions and structures which are 10 or more years old. This is because the salt content of the concrete around the embedded reinforcing steel reaches 0.3 to 0.5 wt% when calculated in terms of NaCl amount in the sand of concrete, and has caused heavy corrosion of the reinforcing steel, resulting in crack occurrence and growth. Concrete buildings and structures of 30 or more years old often exhibit a high salt content exceeding 0.5 wt% when calculated in terms of NaCl amount in the sand of concrete.

It is, therefore, highly desirable to develop a technique which can prevent cracking in the concrete even when the salt content is as high as 0.5 wt% in terms of Nacl amount in the sand of concrete, and also to make it possible to remarkably retard the cracking in the concrete even when the salt content exceeds 0.5 wt% in terms of Nacl amount in the sand of concrete.

SUMMARY OF THE INVENTION

Accordingly, a first object of the invention is to provide a reinforcing steel resistant to salt and capable of preventing deterioration of concrete substantially completely over a long period when the salt content of the concrete is not greater than 0.5 wt% in terms of Nacl amount in the sand of concrete.

To this end, according to a first aspect of the invention, there is provided a reinforcing steel essentially consisting of 0.001 to 1.0 wt% of C, less than 0.01 wt% of Si, 0.01 to 2.0 wt% of Mn, less than 0.015 wt% of P, less than 0.005 wt% of S, 0.01 to 0.5 wt% of Cu, 0.01 to 0.50 wt% of W, 0.001 to 0.10 wt% of Al and the balance Fe and incidental impurities.

One of the most significant features of the invention resides in that the resistance to salt is improved and, hence, the deterioration of concrete is suppressed by extremely reducing the Si and S contents in the steel and adding Cu and W to the steel composition.

Namely, it is considered that a reduction in the Si content suppresses the occurrence and growth of rust, while remarkably increasing the production of $WO_4^-$ inhibitor which is formed as the steel becomes rusty and which inhibitor serves to suppress the corrosion of iron. It is understood also that the content of MnS which serves as the cores of rust is remarkably reduced as a result of a remarkable reduction in the S content, thus achieving a drastic increase in the corrosion resistance.

It seems also that a large reduction in the Si content enriches the contents of W and Cu in adhesive rust on the steel surface, accelerating the formation of goethite and magnetite which are rather impermeable to salt.

A second object of the invention is to provide a reinforcing steel for concrete, which is capable of remarkably retarding the deterioration of the concrete even when the salt content of the concrete exceeds 0.5 wt% in terms of NaCl amount in the sand of concrete.

To this end, the invention provides in its second aspect a reinforcing steel resistant to salt and capable of preventing deterioration of concrete, essentially consisting of 0.001 to 1.0 wt% of C, not greater than 0.05 wt% of Si, 0.01 to 2.0 wt% of Mn, less than 0.015 wt% of P, less than 0.005 wt% of S, 1.0 to 5.5 wt% of Ni, 0.001 to less than 0.5 wt% of W, 0.001 to 0.1 wt% of Al and the balance Fe and incidental impurities.

One of the most significant features of this reinforcing steel resides in that the resistance to salt is improved and the deterioration of concrete subjected to salt of high density is prevented by reducing Si and S contents in the steel and by adding Ni and W to the steel composition.

It is understood that a reduction in Si content effectively suppresses the occurrence and growth of rust and, even after rust has proceeded on the surface of the steel embedded in the concrete, the rust layer does not has high Si concentration but has a high Ni concentrated therein and uniformly contains W diffused from the reinforcing steel, thus remarkably reducing the amount of rust.

It is also understood that a large reduction in the S content significantly reduces the content of MnS which serves as cores causing rust, with a result that the corrosion resistance is drastically improved.

The reasons of limitation of the contents of respective constituents will be explained hereinunder.

The C content is limited to be 0.001 to 1.0 wt% because the steel cannot have required strength when the C content is less than 0.001 wt%, and because any C content more than 1.0 wt% causes embrittlement.

Similarly, the Mn content is selected to range between 0.01 and 2.0 wt% because an Mn content less than 0.01 wt% cannot provide the required strength of the steel, while an Mn content exceeding 2.0 wt% causes embrittlement.

In the first aspect of the invention, the upper limit of Si content is selected to be less than 0.01 wt% when Cu and W are added simultaneously with Si. This is because any reduction of the Si content in the region below 0.01 wt% enhances the rust-preventing effects of Cu and W to thereby remarkably suppress the occurrence of rust.

In the case of the second aspect of the invention, when the content of Ni added together with W exceeds 1 wt%, Ni is extremely enriched in the rust layer so that a remarkable rust preventing effect is obtained even when the Si content is increased to 0.05 wt% or so which is somewhat higher than the Si content in the steel of the first aspect of the invention. This effect is further enhanced as the Si content is below 0.05 wt%. For these reasons, the upper limit of the Si content is selected to be 0.05 wt% in this case. Preferably, in the steel of the second aspect of the invention, the Si content is not greater than 0.02 wt%.

The P content is limited to be less than 0.015 wt% because a P content of 0.015 wt% or higher does not produce any effect for suppressing the growth of rust but, rather, exhibits acceleration of the rusting, when the steel is used in an alkaline atmosphere such as concrete.

In the steel of the first aspect of the invention containing both Cu and W, the Cu content is selected to range between 0.01 and 0.5 wt%. Cu content less than 0.01 wt% hardly causes the enrichment of Cu in the rust layer on the steel surface, so that substantial effect for suppressing the occurrence of the rust can not be obtained. On the other hand, a Cu content in excess of 0.5 wt% is apt to cause an embrittlement of the steel. Preferably, the Cu content ranges between 0.2 and 0.5 wt%. When the Cu content is large, the steel may contain 0.03 to 0.3 wt% of Ni for the purpose of improvement in the hot-rolled scale exfoliation effect.

In the steel of the first aspect in which Cu and W are added simultaneously, the W content is selected to range between 0.01 and 0.5 wt%. Namely, the effect for suppressing the increase in the rust production rate is not appreciable when the W content is less than 0.01 wt%, because the Cu content takes a comparatively small value of not greater than 0.5 wt%. On the other hand, a W content more than 0.5 wt% raises the cost, failing to meet the requirement for economy to which the steel of the first aspect of the invention is intended. Preferably, the W content ranges between 0.08 and 0.20 wt%.

In the steel of the second aspect of the invention containing both Ni and W, W coexisting with Ni remarkably enriched in rust layer serves to change $Fe^{+3}$ in $Fe_2O_3$ and $Fe_3O_4$ in the rust layer into $Fe^{2+}$. This effect is remarkable even when the W content is as small as 0.001 wt% or greater, proving that the growth of the rust layer is remarkably suppressed as a result of coexistence with Ni. This effect, however, is substantially saturated when the W content is increased beyond 0.5 wt%.

In the steel of the second aspect of the invention, therefore, the W content ranges between 0.001 and 0.5 wt%. Preferably, the W content ranges between 0.002 and 0.5 wt% and more preferably between 0.01 and 0.5 wt%.

In the steel of the second aspect of the invention containing both Ni and W, Ni is one of the most significant elements which characterizes the second aspect of the invention. When the rusting of reinforcing steel has processed under the influence o salt of high concentration, Ni is concentrated remarkably in the rust layer so as to substantially suppress the growth of the rust. This effect is not appreciable when the Ni content is less than 1.0 wt%, and is saturated when the Ni content is increased beyond 5.5 wt%. For these reasons, the Ni content ranges between 1.0 wt% and 5.5 wt%. Preferably, the Ni content ranges between 2.0 and 5.5 wt% and, more preferably, the Ni content is above 3 wt% but not greater than 5.5 wt%.

For the purpose of ensuring high weather resistance of the steel in the period before it is embedded in the concrete, the steel of the second aspect may contain a suitable element such as Cu by an amount of 0.01 to 0.3 wt% as well known per se.

The P content in the steel of the second aspect is limited to be less than 0.015 wt% because any P content of not smaller than 0.015 wt% does not produce any effect on the suppression of growth of rust in an alkaline atmosphere such as concrete but rather accelerates the growth of the rust.

The Al content is determined to range between 0.001 wt% and 1.0 wt% in consideration of both deoxidation effect and strength. Namely, an Al content less than 0.001 wt% is insufficient for converting the oxygen to the form of a stable Al oxides, whereas the Al content more than 0.1 wt% allows large inclusions to be formed causing embrittlement of the steel.

The S content is limited to be less than 0.005 wt%, aiming at reducing the content of MnS which serves as cores causing rust. The reduction in the S content is accomplished by adding a desulfurizer such as a Ca compound, rare earth metal or the like. Such a desulfurizer converts MnS into, for example, (Mn, Ca)S to thereby appreciably increase the corrosion resistance of the steel. The addition of such a desulfurizer is well known in the art of this field, so that trace amounts of Ca and Ce is usually contained. Such elements, however, do not adversely alter the corrosion resistance of the steel when their contents range between 0.0001 and 0.05 wt%. Preferably, the S content is not greater than 0.003 wt%.

The steel of the second aspect of the invention can contain 0.01 to 0.2 wt% of one, two or more elements selected from a group consisting of Nb, Ti, V and Mo, for the purpose of improving the strength and toughness of the reinforcing steel. The use of such elements also is well known in this field of art.

When the steel is required to have a specific property such as a high machinability or cutting property, the steel may contain Pb of 0.01 to 0.5 wt%.

The steels of the invention having the compositions as explained hereinbefore can be produced by melting in a converter or an electric furnace followed by ingot-making or blooming or, alternatively, continuously casted and rolled followed by a suitable heat treatment such as patenting. The steel is then drawn to become reinforcing steel.

The steel of the invention can have a composite structure composed of a hardened surface region and a toughened core region, as the occasion demands.

If necessary, the reinforcing steel of the invention can be lined with a zinc plating layer or coated by an organic coating material.

The salt resistant effect of the reinforcing steel of the invention can be equally enjoyed even when the steel is shaped into an H-shaped steel which is embedded in the concrete. Thus, the reinforcing steel of the invention can be used in the form other than round steel bars.

DESCRIPTION OF THE PREFERRED EMBODIMENTS

Samples of reinforcing steel in accordance with the invention were produced by preparing materials of compositions specified by the invention, melting in a converter, ingot-making, blooming and drawing. Similarly, samples of known reinforcing steel of conventional compositions were prepared by melting in an electric furnace. The compositions of the samples and the progress of corrosion of sample steels and degradation of the concretes embedding these sample steels are shown in the following Tables 1*a* and 1*b*.

The test result will be described first with respect to the high-purity reinforcing steel embodying the first aspect of the invention, having high salt resistance containing Cu and W in combination.

The samples of reinforcing steels shown in Table 1*a* are hot-rolled steel bars of 9 mm dia. After machine-grinding followed by degreasing, the reinforcing steel bars were embedded in a concrete mortar having a water-to-cement ratio of 0.60 and salt content of 0.50 wt% in terms of NaCl amount in the sand of concrete, and the pieces of concrete mortal were formed into test pieces of the shape and size as shown in FIG. 1.

After 28 days of curing, the concrete test pieces were placed in a thermo-hygrostat and subjected to repetitional cycles having a period of one week constituted by 48-hour wetting, 24-hour drying, 48-hour wetting and 48-hour drying, and the state of cracking was observed after 56 days, 70 days, 100 days and 138 days from the start of the test.

Figure 1:
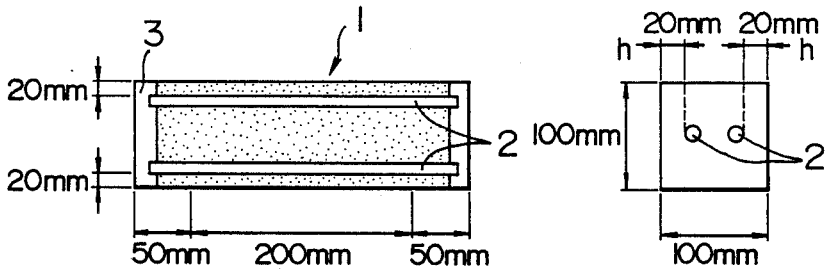
FIG. 1 is an illustration of a test piece of a steel-reinforced concrete having steel bars embedded therein, showing the shape and size of the test piece, as well as the arrangement of the reinforcing steel bars.

In FIG. 1, a reference numeral 1 denotes a concrete test piece, 2 denotes the embedded reinforcing steel bars of 9 mm dia., and 3 denotes an epoxy seal on the mortar. A symbol "ζ" denotes the depth of the reinforcing steel bars as measured from the top surfaces.

Figure 2:
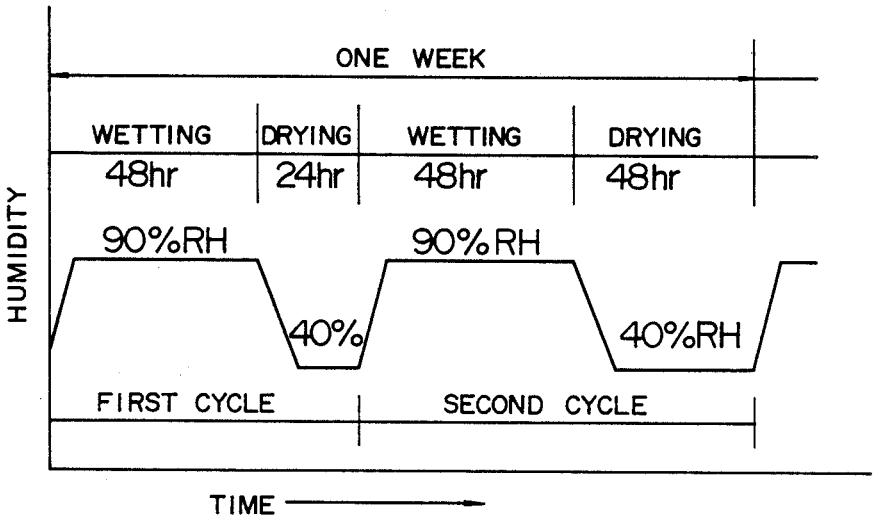
FIG. 2 is a graph showing the conditions under which a test was conducted for the purpose of investigation of rust promotion.

The testing cycles as shown in FIG. 2 creates a very severe conditions comprising repetitional drying and wetting steps at high temperature of 80° C. at which the amount of oxygen dissolved in steam is maximized, thus promoting the corrosion of the embedded reinforcing steel bars. Changes in the depth of neutralization by carbon dioxide gas and corrosion loss of the embedded reinforcing steel bars were also measured in relation to time.

The sizes of the cracks in the concrete test pieces were measured by a crack gauge.

The depth of neutralization by carbon dioxide gas was determined by spraying a solution of phenolphthalenein to the concrete test piece and measuring the depth of the point at which the color was changed from red to colorless from the test piece surface.

The corrosion loss was determined by crushing the concrete test piece, chemically removing the rust from the exposed reinforcing steel, measuring the weight of the steel after the removal of the rust, and subtracting the measured weight from the weight before the corrosion. Thus, the corrosion loss is expressed in terms of loss of weight per 28 cm length.

The results of these measurements are shown in Table 1-b.

The salt content of the concrete was measured by collecting powders of crushed concrete around the reinforcing steel bar and conducting measurement in accordance with the methods as specified by Japanese Concrete Engineering Association and Japanese Cement Association: namely, partly by measuring Cl in accordance with a nitric acid decomposition method of chemical analysis and partly by measuring Cl in accordance with cold-water extraction method. The thus measured values of Cl were converted into salt content and are expressed in terms of the NaCl amount (wt%) in the sand of concrete.

Figure 3A:
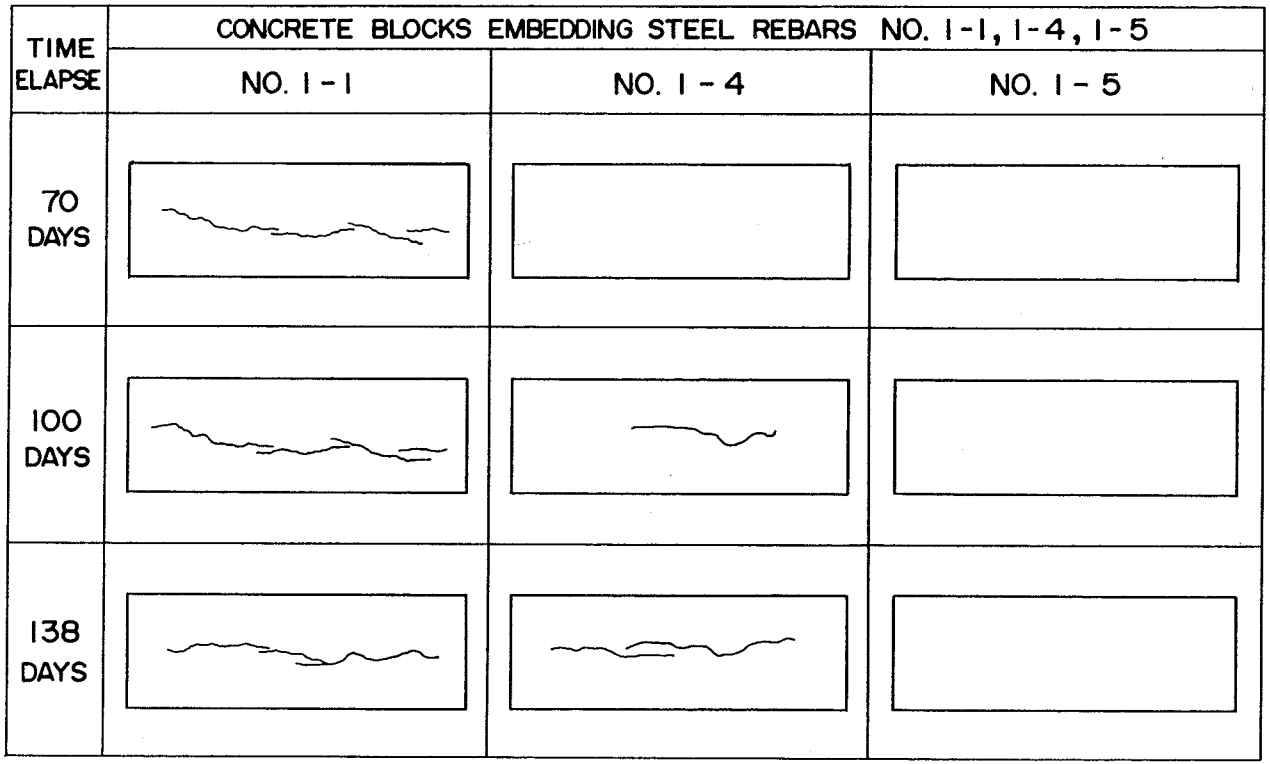
FIGS. 3*a* and 3*b* are sketches and photographs both showing the state of cracking in a concrete reinforced with a steel in accordance with the first aspect of the invention in comparison with that in a concrete reinforced with a conventional reinforcing steel, respectively.
Figure 3B:
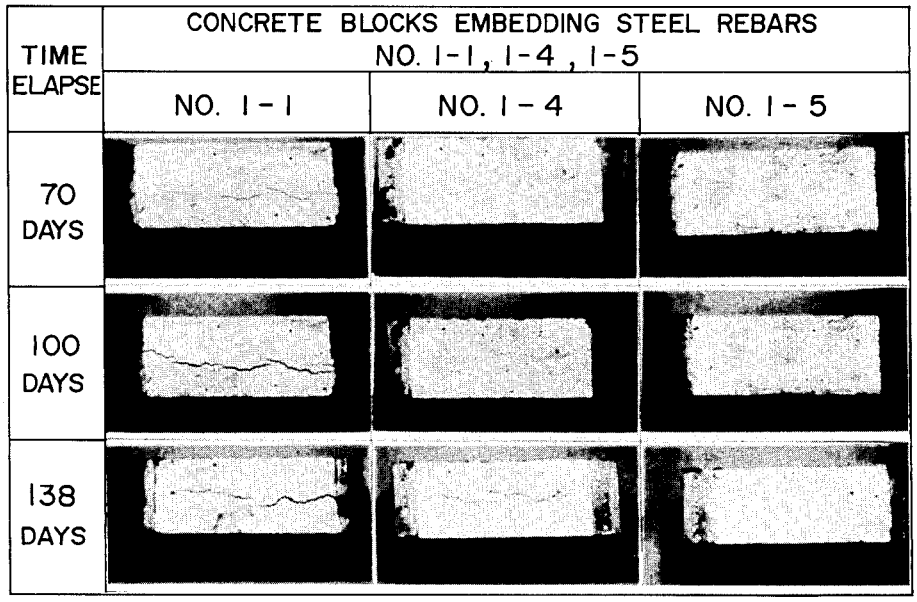

FIGS. 3*a* and 3*b* show the states of deterioration of the concrete test pieces reinforced with the reinforcing steel sample Nos. 1-1, 1-4 and 1-5, respectively. FIG. 3*b* is a photograph in accordance with which the sketches shown in FIG. 3*a* are prepared.

Concrete test pieces reinforced with the reinforcing steel sample Nos. 1-1, 1-2, 1-3, 1-4 and 1-5 were exposed in the aforementioned thermo-hygrostat for 100 days. The salt content in terms of the NaCl amount (wt%) in the sand of concrete was determined for each concrete test piece by chemical determination of the salt content around the reinforcing steel and the amount of free salt, i.e., the salt existing in the form of $Cl^{31}$, extracted by means of cold water. In all concrete test pieces, the salt contents were about 0.50 wt% while the amounts of free salt were about 0.25 wt%.

This proves that the reinforcing steel bars in accordance with the invention are not corroded substantially even when the salt content of concrete around the steel bars is as high as 0.5 wt% in terms of NaCl amount in the sand of concrete and, hence, are capable of preventing deterioration of the concrete almost completely.

A description will be made hereinunder as to the result of the test conducted for the purpose of investigation of the performance of anti-salt high-purity reinforcing steel in accordance with the second aspect of the invention, i.e., the steel containing Ni and W in combination. The results test are shown in Table 2. More specifically, the samples of reinforcing steel appearing in Table 2 are of the same shape and size as the steel samples of the first aspect of the invention. The samples are subjected to the same surface treatment as those applied to the steel samples of the first aspect and were embedded in the same concrete mortar as that used for the reinforcing steel of the first aspect, although in this case the salt content was increased to 1.0 wt%. The concrete test pieces thus prepared were subjected to a wetting/drying cycle test conducted under the same conditions as those in the test for the reinforcing steel of the first aspect of the invention, and the state of generation of cracks, depth of neutralization and corrosion loss of the embedded reinforcing steel were measured after 56 days and 70 days from the start of the test.

The concrete test pieces reinforced with the reinforcing steel sample Nos. 2-1, 2-2, 2-4, 2-5 and 2-6 shown in Table were placed in the aforementioned thermostat thermo-hygrostat and were subjected to the wetting/drying cycle test. The salt contents of the concrete around the reinforcing steel bars and the amounts of free salt extracted by cold water were chemically analyzed and determined in terms of the NaCl amount in the sand of concrete, after 56 days and 70 days from the start of the test. The salt contents and the amounts of free salt were about 1.0 wt% and about 0.6 wt%, respectively, in all test pieces.

These test result show that the reinforcing steel in accordance with the second aspect of the invention exhibits an extremely small rate of corrosion as compared with the conventional reinforcing steel, even when the salt content of the concrete is as great as 1.0 wt% in terms of the NaCl amount in the sand of concrete and, hence, remarkably delays the deterioration of the concrete. Thus, the reinforcing steel in accordance with the second aspect of the invention can effectively prevent deterioration of concrete from occurring even under such severe conditions that the salt is finally concentrated to a high value of 1.0 wt% in terms of the NaCl amount in the sand of concrete. The sample No. 2-3, which is a steel in accordance with the first aspect of the invention, is rather inferior to the steels of the second aspect with respect to both the effect for preventing the deterioration of concrete and corrosion resistance.

Figure 4A:
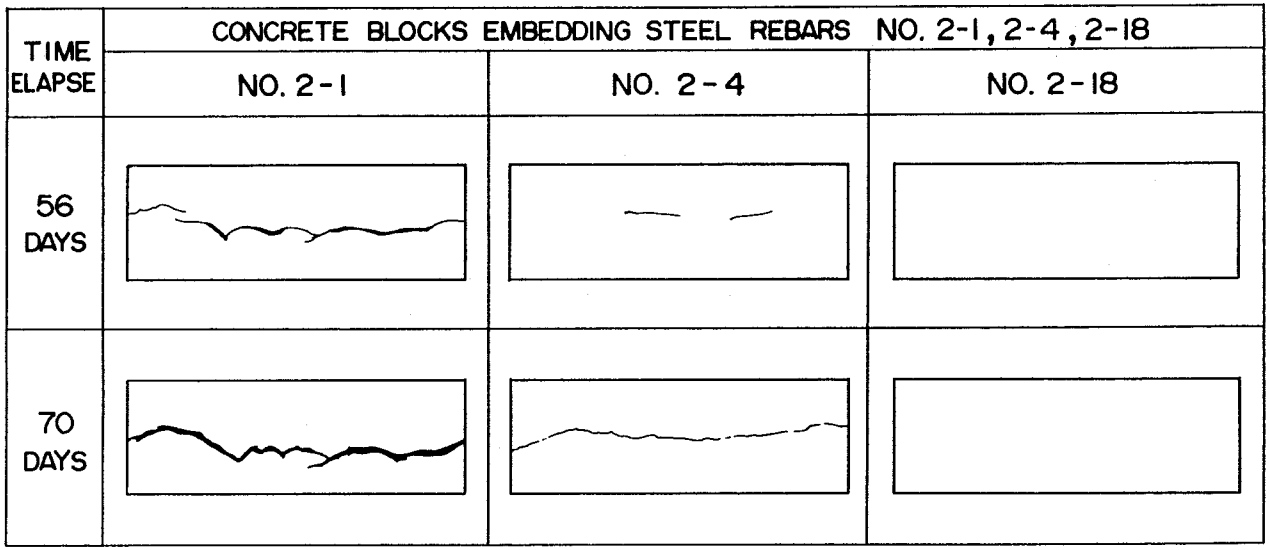
FIGS. 4*a* and 4*b* are sketches and photographs both showing the state of cracking in a concrete reinforced with a reinforcing steel in accordance with the second aspect in comparison with that in a concrete reinforced with a comparison reinforcing steel, respectively.
Figure 4B:
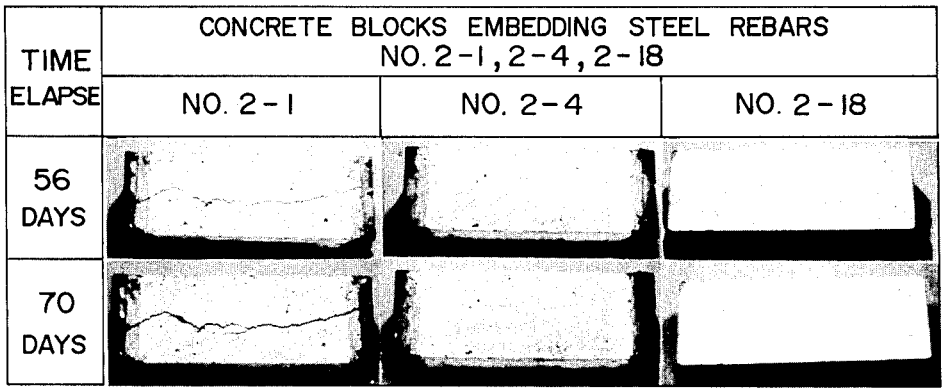

FIGS. 4*a* and 4*b* illustrate the states of deterioration of concrete test pieces reinforced with the reinforcing steel sample Nos. 2-1, 2-4 and 2-18 appearing in Table 2. FIG. 4*b* is photographs of the test pieces used as the basis for the sketches in FIG. 4*a*.

The reinforcing steel in accordance with the invention is capable of ensuring high durability of concrete constructions and structures which are used under salty conditions, well satisfying the current demand for high salt-resistance of steel-reinforced concrete constructions and structures.

Thus, the reinforcing steel of the invention ensures longer service life and higher stability of concrete constructions and structures and find wide use in various fields.

TABLE 1a

| No. | Compositions (%) C | Si | Mn | P | S | Cu | W | Al | Ca,Ce | Other element |
|---|---|---|---|---|---|---|---|---|---|---|
| | | | | | | Comparison steels | | | | |
| 1-1 | 0.14 | 0.130 | 0.65 | 0.017 | 0.023 | 0.27 | — | 0.005 | — | |
| 1-2 | 0.13 | 0.080 | 0.55 | 0.023 | 0.017 | 0.44 | — | 0.004 | — | |
| 1-3 | 0.27 | 0.100 | 0.60 | 0.029 | 0.043 | 0.32 | — | 0.001 | — | |
| 1-4 | 0.31 | 0.021 | 0.96 | 0.008 | 0.003 | 0.26 | 0.18 | 0.009 | Ca < 0.0002 | Ni 0.02 |
| | | | | | | Steels of invention | | | | |
| 1-5 | 0.25 | 0.007 | 0.60 | 0.011 | 0.001 | 0.23 | 0.12 | 0.023 | Ca < 0.0002 | |
| 1-6 | 0.26 | 0.008 | 0.61 | 0.010 | 0.001 | 0.25 | 0.09 | 0.026 | Ca < 0.0001 | |
| 1-7 | 0.35 | 0.004 | 0.81 | 0.012 | 0.0009 | 0.26 | 0.10 | 0.015 | Ca 0.0001 | |
| 1-8 | 0.07 | 0.005 | 1.23 | 0.008 | 0.0015 | 0.23 | 0.18 | 0.008 | Ca < 0.0001 | Nb 0.03 |
| 1-9 | 0.78 | 0.005 | 0.23 | 0.009 | 0.001 | 0.24 | 0.10 | 0.018 | Ca 0.0002 | |
| 1-10 | 0.21 | 0.006 | 0.59 | 0.012 | 0.001 | 0.30 | 0.12 | 0.026 | Ca < 0.0001 | V 0.02 |
| 1-11 | 0.01 | 0.005 | 1.50 | 0.013 | 0.001 | 0.27 | 0.41 | 0.028 | Ca 0.0001, Ce 0.003 | |
| 1-12 | 0.08 | 0.009 | 1.80 | 0.011 | 0.001 | 0.25 | 0.20 | 0.020 | Ca 0.0001 | Nb 0.03 |
| 1-13 | 0.05 | 0.008 | 1.50 | 0.012 | 0.0007 | 0.41 | 0.18 | 0.026 | Ca 0.0001 | Ni 0.03 |

TABLE 1b

| No. | Maximum crack width (mm) in concrete test piece (including dropped portion) 56 days | 70 days | 100 days | 138 days | Maximum corrosion loss of embedded steel (g/9 mm (dia.) × 28 cm) 70 days | 100 days | $CO_2$ Penetration Depth (mm) 70 days | 100 days |
|---|---|---|---|---|---|---|---|---|
| | | | | Comparison steels | | | | |
| 1-1 | 0.20 | 0.80 | 3.00 | 4.00 | 3.8 | 5.5 | 4.7 | 9.0 |
| 1-2 | 0.10 | 0.43 | 2.00 | 3.00 | 3.2 | 5.0 | 4.1 | 9.0 |
| 1-3 | 0.12 | 0.48 | 2.10 | 2.94 | 3.5 | 5.2 | 4.3 | 9.1 |
| 1-4 | 0.04 | 0.08 | 0.40 | 0.65 | 1.7 | 2.9 | 2.6 | 4.7 |
| | | | | Steels of invention | | | | |
| 1-5 | 0.04 | 0.04 | 0.06 | 0.08 | 1.6 | 2.0 | 1.7 | 3.2 |
| 1-6 | 0.04 | 0.06 | 0.06 | 0.06 | 1.5 | 1.9 | 1.6 | 3.1 |
| 1-7 | 0.04 | 0.04 | 0.08 | 0.08 | 1.7 | 2.1 | 1.7 | 3.0 |
| 1-8 | 0.04 | 0.04 | 0.06 | 0.08 | 1.6 | 2.0 | 1.6 | 3.1 |
| 1-9 | 0.06 | 0.08 | 0.10 | 0.10 | 1.8 | 2.1 | 1.8 | 3.3 |
| 1-10 | 0.05 | 0.06 | 0.08 | 0.10 | 1.7 | 2.1 | 1.8 | 3.2 |
| 1-11 | 0.04 | 0.06 | 0.08 | 0.10 | 1.6 | 2.0 | 1.9 | 3.1 |

TABLE 1b-continued

| No. | Maximum crack width (mm) in concrete test piece (including dropped portion) | | | | Maximum corrosion loss of embedded steel (g/9 mm (dia.) × 28 cm | | $CO_2$ Penetration Depth (mm) | |
|---|---|---|---|---|---|---|---|---|
| | 56 days | 70 days | 100 days | 138 days | 70 days | 100 days | 70 days | 100 days |
| 1-12 | 0.04 | 0.04 | 0.06 | 0.06 | 1.5 | 1.9 | 1.6 | 3.0 |
| 1-13 | 0.06 | 0.08 | 0.10 | 0.10 | 1.6 | 2.1 | 1.7 | 3.2 |

Covering Depth: 20 mm
(Depth from concrete surface to steel)

TABLE 2

| No. | Compositions (%) | | | | | | | | | | Maximum crack width in concrete test piece (mm) (including dropped portion) | | Maximum corrosion loss of embedded steel (g/9 mmΦ × 28 cm) | | $CO_2$ Penetration depth (mm) | |
|---|---|---|---|---|---|---|---|---|---|---|---|---|---|---|---|---|
| | C | Si | Mn | P | S | Ni | W | Al | Ca, Ce | Others | 56 days | 70 days | 56 days | 70 days | 56 days | 70 days |
| | | | | | | | | | Comparison steels | | | | | | | |
| 2-1 | 0.14 | 0.13 | 0.65 | 0.017 | 0.023 | 0.08 | | 0.005 | | Cu 0.27 | 1.0 | 8.0 | 7.2 | 12.4 | 6.5 | 10.8 |
| 2-2 | 0.13 | 0.08 | 0.55 | 0.023 | 0.017 | | | 0.004 | | Cu 0.44 | 1.4 | 9.0 | 9.0 | 11.9 | 6.9 | 10.4 |
| 2-3 | 0.25 | 0.007 | 0.60 | 0.011 | 0.001 | 0.23 | 0.12 | 0.023 | | Cu 0.23 | 0.2 | 1.0 | 3.8 | 5.7 | 3.3 | 5.2 |
| | | | | | | | | | Steels of invention | | | | | | | |
| 2-4 | 0.20 | 0.048 | 0.31 | 0.012 | 0.002 | 3.47 | 0.012 | 0.023 | Ca 0.0002 | | 0.11 | 0.29 | 2.0 | 4.1 | 2.9 | 4.8 |
| 2-5 | 0.21 | 0.050 | 0.30 | 0.011 | 0.002 | 3.48 | 0.005 | 0.022 | Ca <0.0002 | | 0.10 | 0.30 | 2.1 | 4.3 | 3.0 | 5.0 |
| 2-6 | 0.20 | 0.040 | 0.29 | 0.010 | 0.001 | 3.50 | 0.002 | 0.020 | Ca <0.0002 | | 0.08 | 0.20 | 2.0 | 3.6 | 2.6 | 4.2 |
| 2-7 | 0.05 | 0.010 | 0.80 | 0.012 | 0.001 | 3.38 | 0.010 | 0.021 | Ca 0.0001 | | 0.06 | 0.20 | 2.1 | 3.8 | 2.7 | 4.3 |
| 2-8 | 0.05 | 0.008 | 0.65 | 0.008 | 0.001 | 3.52 | 0.007 | 0.018 | Ca <0.0002 | | 0.08 | 0.18 | 1.8 | 3.7 | 2.5 | 4.1 |
| 2-9 | 0.05 | 0.007 | 0.69 | 0.010 | 0 004 | 3.50 | 0.005 | 0.023 | Ca 0.0001 | | 0.11 | 0.31 | 2.2 | 4.4 | 2.9 | 4.4 |
| 2-10 | 0.05 | 0.006 | 0.75 | 0 011 | 0.003 | 3.10 | 0.006 | 0.026 | Ca <0.0002 | | 0.10 | 0.32 | 2.1 | 4.0 | 3.1 | 4.8 |
| 2-11 | 0.06 | 0.01 | 0.50 | 0.009 | 0.001 | 3.46 | 0.001 | 0.025 | Ca 0.0001 | Nb 0.02 | 0.04 | 0.15 | 1.8 | 3.9 | 2.7 | 4.1 |
| 2-12 | 0.05 | 0.008 | 0.60 | 0.010 | 0.004 | 3.90 | 0.050 | 0.019 | Ca <0.0002 | V 0.03 | 0.12 | 0.31 | 2.3 | 4.4 | 3.1 | 4.9 |
| 2-13 | 0.06 | 0.007 | 0.48 | 0.011 | 0.001 | 3.52 | 0.100 | 0.021 | Ca 0.0001 | Nb 0.03, Cu 0.05 | 0.04 | 0.16 | 1.7 | 3.6 | 2.5 | 4.0 |
| 2-14 | 0.78 | 0.01 | 0.28 | 0.008 | 0.003 | 3.51 | 0.080 | 0.018 | Ca 0.0001 | | 0.08 | 0.18 | 1.8 | 3.7 | 2.7 | 4.3 |
| 2-15 | 0.75 | 0.01 | 0.30 | 0.010 | 0.001 | 3.10 | 0.070 | 0.020 | Ca <0.0002 | | 0.06 | 0.15 | 1.6 | 3.2 | 2.5 | 4.1 |
| 2-16 | 0.15 | 0.02 | 0.60 | 0.010 | 0.0048 | 3.72 | 0.31 | 0.024 | Ca <0.0002 | | 0.04 | 0.41 | 1.6 | 4.7 | 2.4 | 5.8 |
| 2-17 | 0.22 | 0.008 | 0.32 | 0.010 | 0.0038 | 2.06 | 0.31 | 0.023 | Ca <0.0002 | | 0.04 | 0.20 | 1.7 | 3.8 | 2.6 | 4.3 |
| 2-18 | 0.21 | 0.016 | 0.31 | 0.011 | 0.0011 | 3.57 | 0.32 | 0.015 | Ca <0.0002 | | 0 | 0.06 | 0.5 | 1.5 | 2.1 | 2.6 |

What is claimed is:

1. A high-purity reinforcing steel resistance to salt and capable of remarkably retarding deterioration of concrete even under such a severe corrosive condition that the salt content of said concrete exceeds 0.5 wt% in terms of NaCl amount in sand of concrete, said reinforcing steel consisting of 0.001 to 1.0 wt% of C, not greater than 0.05 wt% of Si, 0.01 to 2.0 wt% of Mn, less than 0.015 wt% of P, less than 0.005 wt% of S, 1.0 to 5.5 wt% of Ni, 0.001 to 0.5 wt% of W, 0.001 to 0.1 wt% of Al and the balance Fe and incidental impurities.

2. A reinforcing steel according to claim 1 further containing 0.0001 to 0.005 wt% in total of at least one member selected from a group consisting of Ca and Ce.

3. A reinforcing steel according to claim 1 further containing 0.01 to 0.2 wt% in total of at least one member selected from a group consisting of Nb, Ti, V and Mo.

4. The steel of claim 1 wherein the amount of Si is not more than 0.02 wt%.

5. The steel of claim 1 wherein the amount of W is 0.01 to 0.5 wt%.

6. The steel of claim 1 wherein the amount of Ni is 2 to 5.5 wt%.

7. The steel of claim 1 wherein the amount of Ni is 3 to 5.5 wt%.

8. The steel of claim 1 wherein the amount of W is 0.002 to 0.5 wt% and the amount of Ni is 2 to 5.5 wt%.

9. The steel of claim 1 wherein the amount of W is 0.01 to 0.5 wt% and the amount of Ni is 3 to 5.5 wt%.

10. A high-purity reinforcing steel resistance to salt and capable of remarkably retarding deterioration of concrete even under such a severe corrosive condition that the salt content of said concrete exceeds 0.5 wt % in terms of NaCl amount in sand of concrete, said reinforcing steel consisting essentially of 0.001 to 1.0 wt % of C, not greater than 0.05 wt % of Si, 0.01 to 2.0 wt % of Mn, less than 0.015 wt % of P, less than 0.005 wt % of S, 1.0 to 5.5 wt % of Ni, 0.001 to 0.5 wt % of W, 0.001 to 0.1 wt % of Al, and further containing at least one member selected from the group consisting of:

(1) 0.0001 to 0.005 wt % in total of at least one selected from a group consisting of Ca and Ce;

(2) 0.01 to 0.2 wt % in total of at least one selected from a group consisting of Nb, Ti, V, and Mo; and (3) 0.01 to 0.5 wt % of Pb for improving the cutting property;

and the balance Fe and incidental impurities.

11. The steel of claim 10 wherein the amount of Si is not more than 0.02 wt%.

* * * * *